US006447192B1

(12) United States Patent
Butz et al.

(10) Patent No.: US 6,447,192 B1
(45) Date of Patent: Sep. 10, 2002

(54) DEVICE FOR RECEIVING AND DISPENSING A COATABLE MATERIAL

(75) Inventors: Wolfgang Butz; Peter Gonzalez-Koehn, both of Duesseldorf; Axel Uwe Kochler, Juechen; Peter Kuklik, Haan; Rainer Dahm, Mettmann; Karsten Wolf, Korschenbroich, all of (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/960,101

(22) Filed: Sep. 21, 2001

(30) Foreign Application Priority Data

Sep. 22, 2000 (DE) ..... 100 47 069

(51) Int. Cl.[7] ..... B43K 21/08
(52) U.S. Cl. ..... 401/75; 401/86; 401/175
(58) Field of Search ..... 401/175, 171, 401/88, 68, 73, 75, 86

(56) References Cited

U.S. PATENT DOCUMENTS 4,812,066 A * 3/1989 Gueret ..... 401/86
4,950,094 A * 8/1990 Yorks ..... 401/75
5,868,510 A * 2/1999 Lacout et al. ..... 401/75
6,299,369 B1 * 10/2001 Baines et al. ..... 401/75

FOREIGN PATENT DOCUMENTS

DE 2 139 123 2/1973

* cited by examiner

*Primary Examiner*—David J. Walczak
(74) *Attorney, Agent, or Firm*—Stephen D. Harper; Glenn E. J. Murphy

(57) ABSTRACT

A device for receiving and dispensing a coatable material comprises a sleeve-shaped receiving element in which is arranged a piston-shaped element displaceable in longitudinal direction and provided with an internal thread, the element carrying the coatable material and being displaceable by an externally operable socket-shaped rotary grip, wherein the rotary grip comprises a screw spindle co-operable with the internal thread of the piston-shaped element, the device being so improved that detaching of the coating material from the piston-shaped element is reliably avoided without impairing the sealing function.

11 Claims, 1 Drawing Sheet

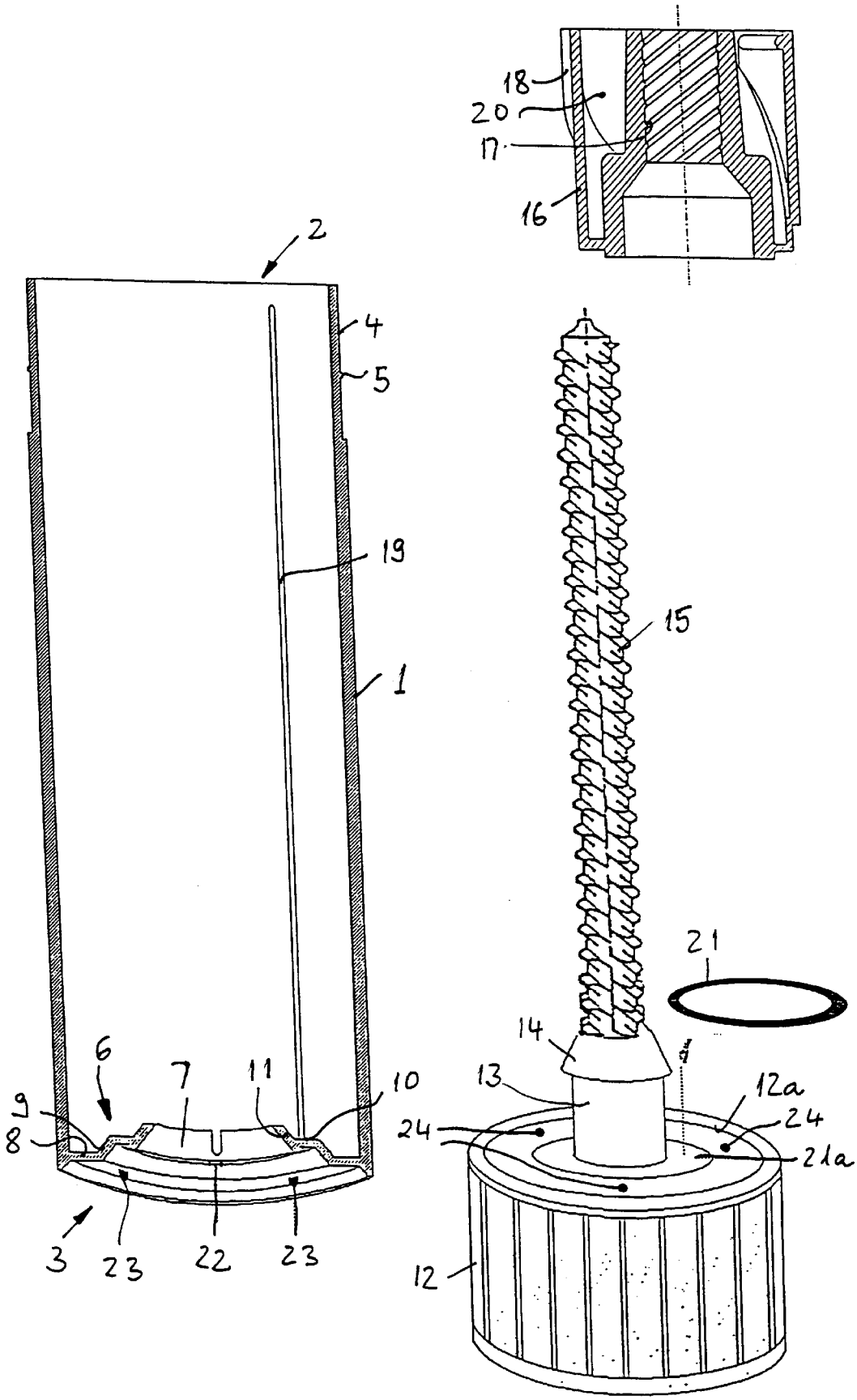
18
20
17
16
2
4
5
19
1
15
21
14
13
12a
24
24
21a
12
6
7
11
10
9
8
3
23
22
23

DEVICE FOR RECEIVING AND DISPENSING A COATABLE MATERIAL

This application claims priority under 35 U.S.C. §119 of German application DE 100 47 069.6 filed in the German Patent Office on Sep. 22, 2000, the disclosure of which is hereby incorporated by reference.

FIELD OF THE INVENTION

The invention relates to a device for receiving and dispensing a coatable material, comprising a sleeve-shaped receiving element, on the open delivery end of which a closure cap can be detachably pushed on and in which there is arranged a piston-shaped element, which is secure against rotation and is displaceable in longitudinal direction up to the delivery end and which is provided with an internal thread and carries the coatable material, the element being displaceable by an externally operable socket-shaped rotary grip provided at the other end of the receiving element, wherein the rotary grip comprises a screw spindle which is rotatably mounted in a passage opening in the sleeve base of the receiving element and held in axial direction and which co-operates with the internal thread of the piston-shaped element, wherein sealing means are provided for sealing the passage opening.

BACKGROUND OF THE INVENTION

A device of that kind of the applicant has been known for a long time, for example in the form according to German specification 21 39 123 B2. Such a known glue stick comprises a cylindrical sleeve, the open delivery end of which is provided with a detachable closure cap in the case of non-use for the purpose of avoiding drying out of the glue mass disposed in the sleeve. The glue mass within the sleeve is cast into a piston-shaped element and together with this is held in the sleeve to be secure against rotation and arranged to be displaceable in the longitudinal direction of the sleeve, wherein, for displacement, the piston-shaped element is provided in the centre with an internal threaded bore in which a threaded spindle engages, the spindle extending almost over the entire length of the sleeve and thus also extending through the glue mass and integrally transitioning at the end into a knurled, nut-shaped rotary grip, which is rotatably mounted at the other end of the sleeve and protrudes outwardly of the sleeve at the foot thereof and enables manipulation of the device, in that, with the sleeve firmly held, the rotary grip is turned in one or the other direction so that the piston-shaped element and the glue mass connected therewith move relative to the sleeve in one or the other direction and enable either dispensing of the glue or retraction of the glue mass into the sleeve.

This known device has proved itself to be best for a long time, since an easily handled and at the same time very sturdy object is made available. However, since the device is provided in the region of the passage opening in the sleeve base with sealing means in order to avoid drying out of the glue mass, it has proved in practice that on retraction of the piston-shaped element an excess pressure can build up in the region behind the piston-shaped element in the sleeve-shaped receiving element and can frequently have the consequence that the coatable material is quasi popped off the piston-shaped element, whereby the device is unusable.

SUMMARY OF THE INVENTION

It is accordingly the object of the invention to s o improve a device according to the category that, without impairment of the sealing function, detaching of the coatable material from the piston-shaped element is reliably avoided.

According to the invention this object is met in the case of a device of the kind designated in the introduction in that an encircling sealing element is arranged radially outside the passage opening in the sleeve base and bears against the sleeve base and the associated end face of the rotary grip, that at least one ventilating opening is provided in the sleeve base radially within or in the region of the sealing element and that spacer means, which in the operative position thereof in at least one defined rotational setting enlarge the spacing between the sleeve base and the end face of the rotary grip, are provided at the sleeve base and/or at the end face of the rotary grip.

In the case of such a design of the invention an excess pressure build up in the sleeve-shaped receiving element in the region between the piston-shaped element and the sleeve base when the piston-shaped element is rotated back is avoided without thereby impairing the sealing function of the device. At least once per revolution the spacer means move into their operative position and enlarge the spacing between the sleeve base and the end face of the rotary grip so that the sealing element is transiently relieved and air can escape through the ventilating opening in the sleeve base, so that a build up of excess pressure does not occur. On further rotation of the rotary grip relative to the sleeve-shaped receiving element the spacer means move out of function again so that the necessary sealing function is guaranteed, i.e. the ventilating opening is sealingly closed by the sealing element disposed back in function. Since the ventilating opening during the rotating back of the piston-shaped element is freed only intermittently, several ventilating openings of that kind can also be provided in accordance with the size of the particular device.

In order to facilitate manipulation of the device it is advantageously provided that the spacer means are formed so that they go out of their operative position automatically. If, for example, the rotary actuation of the rotary grip relative to the sleeve-shaped receiving element by the user ends in exactly the operative position of the spacer means, these then move out of their operative position automatically so that the full sealing function is guaranteed.

In an embodiment which is constructionally particularly advantageous the spacer means are formed by detent projections, which are arranged on a common circumference, at the sleeve base and at the end face of the rotary grip. When the socket-shaped rotary grip is turned, the dog-like detent projections hit against one another, whereby the spacing of the sleeve base and rotary grip is transiently increased and the seal is relieved for this instant, so that air can exit through the ventilating opening.

In that case the detent projections are preferably formed to be inclined in such a manner that in their operative position they are disposed in an unstable contact position. It can thereby be achieved in simple manner that the detent projections do not remain in their operative position, which would impair the sealing function.

The detent projections are preferably arranged radially outside the sealing element and the sealing element is constructed as an annular seal.

In a further preferred constructional embodiment the sleeve base is formed to be inclined inwardly in step-shaped manner, wherein the detent projections are provided in a first, outer encircling step and the ventilating opening and sealing element are provided in a more inwardly disposed second step. By virtue of this design the afore-mentioned elements are arranged in the interior of the device and thus protected against the outside.

BRIEF DESCRIPTION OF THE DRAWING

The invention is explained in more detail in the following by way of example with reference to the drawing. This shows, in the single FIGURE, a device according to the invention partly in section and in exploded illustration.

DETAILED DESCRIPTION OF THE INVENTION

A device according to the invention for receiving and dispensing a coatable material is constructed in the embodiment as a glue stick, i.e. the coatable material is a glue mass. The device can obviously also be constructed as a lip balm stick and other uses are equally possible.

The device according to the invention comprises, firstly, a sleeve-shaped receiving element 1, the upper delivery end—which is open in the use state—of which is denoted by 2 and the other end of which is denoted by 3. A narrowed portion 4 with an encircling bead 5, which serves the purpose of detenting and sealably receiving a closure cap (not illustrated), is provided externally on the sleeve-shaped receiving element 1 in the region of the delivery end 2.

The sleeve-shaped receiving element 1 has at the other end 3 a sleeve base 6 with a central passage opening 7. The sleeve base 6 is in that case constructed to be inwardly inclined in step-shaped manner by a first, outer encircling step 8, an obliquely extending transition region 9, a second encircling step 10 disposed further inwardly and a conical annular region 11 bounding the passage opening 7.

A socket shaped rotary grip 12 is to be mounted at the receiving element 1 through the passage opening 7 in the sleeve base 6. For that purpose the socket-shaped rotary grip 12 has at the upper end a tubular protrusion 13 which goes over into a widened, conical region 14, to which is connected, preferably integrally, a screw spindle 15 having a length approximately corresponding to the height of the interior of the receiving element 1.

For assembly of the device the rotary grip 12 together with the screw spindle 15 is introduced from below through the passage opening 7 into the receiving element 1 and clicked into place, whereby the conical projection 14 bears in detenting manner against the annular region 11 of the sleeve base 6 and, in particular, in such a manner that the rotary grip 12 can be rotated relative to the sleeve-shaped receiving element 1 and at the same time is held at the receiving element 1 in axial direction with a small play.

When the rotary grip 12 is mounted at the receiving element 1, a piston-shaped element 16, which is equipped with an internal thread 17, is introduced into the receiving element 1 and screwed onto the screw spindle 15, wherein the piston-shaped element 16 has at the outside a projection 18 which engages in a groove 19 extending over the height of the receiving element 1, whereby security of the piston-shaped element 16 against rotation relative to the receiving element 1 is achieved. Through rotation of the screw spindle 15 the piston-shaped element 16 is thereby displaced in longitudinal direction relative to the receiving element 1 in one or other direction.

The piston-shaped element 16 has at the inner side a receiving region 20 which carries the coatable mass (not illustrated), for example, glue.

In order to ensure a secure sealing of the device when the closure cap is in place, an encircling annular seal 21 is provided radially outside the passage opening 7 and bears against the sleeve base 6, preferably in the second region 10 thereof, and against the rotary grip 12 at a sealing surface 21*a*. In the vicinity of this annular seal 21 the sleeve base 6 has in its second region 10 at least one ventilating opening 22 which is normally sealed by the annular seal 21. In that case the ventilating opening 22 is formed as a bore in the embodiment, but it can alternatively also be formed as a groove or the like.

In order to free the ventilating opening 22, spacer means are provided in the sleeve base 6 and/or at the end face 12*a* of the rotary grip 12 and in their operative position in at least one defined rotational setting enlarge the spacing between the sleeve base 6 and the end face 12*a* of the rotary grip 12 in such a manner that the annular seal 21 is relieved and the ventilating opening 22 is freed for a time.

In the embodiment these spacer means are formed by detent projections 23 arranged on a common circumference at the sleeve base 6, preferably in the first region 9 thereof, and further detent projections 24 at the end face 12*a* of the rotary grip 12. The detent projections 23 and 24 are in that case preferably constructed to be identical and symmetrically distributed in each instance on the same circumference, so that they come into contact with one another at the same time in a specific rotational setting and increase the axial spacing between the sleeve base 6 and the end face 12*a* of the rotary grip 12. This offers the following significant advantage:

If after actuation of the device the coatable mass, for example glue mass, is to be retracted again the rotary grip 12 is actuated in the corresponding direction and the piston-shaped element 16 together with the coatable mass disposed therein returns into the interior of the receiving element 1. In that case an excess pressure can build up between the piston-shaped element 16 and the sleeve base 6 and in the extreme case can have the consequence that the coatable mass detaches from the sleeve-shaped element 16 and renders the device is unusable. However, by virtue of the arrangement according to the invention it is now ensured that the detent projections 23 and 24 necessarily come into respective contact once per revolution and thereby by reason of the increase in the axial spacing between the sleeve base 6 and the end face 12*a* of the rotary grip 12 the annular seal 21 is relieved and thus the ventilating opening 22 freed, so that the excess pressure in this region of the receiving element 1 can decay.

In order, however, to subsequently guarantee a faultless sealing of the device again the projections 23 and 24 are preferably formed to be inclined in such a manner that in the operative position they are disposed in an unstable contact position, i.e. even if by chance at the end of the process of inward rotation in the detent projections 23 and 24 are disposed in mutual contact and thus the ventilating opening 22 may be freed, the detent projections 23, 24 automatically go back out of engagement and bring the annular seal 21 back into its function.

The invention is obviously not restricted to the illustrated embodiment. Further embodiments are possible without departing from the inventive concept. Thus, optionally also several ventilating openings 22 can be provided and the spacer means can also be designed in a different manner.

What is claimed is:

1. A device for receiving and dispensing a coatable material, comprising a sleeve-shaped receiving element having at one end a sleeve base and on the other end an open delivery end onto which a closure cap can be detachably pushed, in which receiving element is arranged a piston-shaped element that is secure against rotation, is displaceable in longitudinal direction to the delivery end, is provided with an internal thread, and carries the coatable material, the piston-shaped element being displaceable by an externally operable socket-shaped rotary grip provided at the sleeve base end of the receiving element, wherein the rotary grip comprises a screw spindle that is rotatably mounted in a passage opening in the sleeve base of the receiving element and held in axial direction and that co-operates with the internal thread of the piston-shaped element, wherein a sealing means is provided for sealing the passage opening, said sealing means comprising an encircling sealing element (21) arranged radially outside the passage opening (7) in the sleeve base (6) and bearing against the sleeve base (6) and an associated end face **(12*a*) of the rotary grip (12), at least one ventilating opening (22) being provided in the sleeve base (6) radially within or in the region of the sealing element (21), and wherein are provided, at either or both of the sleeve base (6) and the end face (12*a*) of the rotary grip (12), one or more spacer means (23, 24) that in operative position in at least one defined rotational setting enlarge a spacing between the sleeve base (6) and the end face (12*a*) of the rotary grip (12)**.

2. The device of claim 1, wherein the spacer means (23, 24) are constructed so as to automatically move out of the operative position thereof.

3. The device of claim 2, wherein the spacer means (23, 24) are formed by detent projections that are arranged on a common circumference, at the sleeve base (6) and at the end face **(12*a*) of the rotary grip (12)**.

4. The device of claim 3, wherein the detent projections (23, 24) are formed to be inclined in such a manner that in the operative position thereof they are disposed in an unstable contact position relative to one another.

5. The device of claim 4, wherein the detent projections (23, 24) are arranged radially outside the sealing element (21).

6. The device of claim 1, wherein the spacer means (23, 24) are formed by detent projections that are arranged on a common circumference, at the sleeve base (6) and at the end face **(12*a*) of the rotary grip (12)**.

7. The device of claim 6, wherein the detent projections (23, 24) are formed to be inclined in such a manner that in the operative position thereof they are disposed in an unstable contact position relative to one another.

8. The device of claim 7, wherein the detent projections (23, 24) are arranged radially outside the sealing element (21).

9. The device of claim 1, wherein the sealing element comprises an annular seal (21).

10. The device of claim 1, wherein the sleeve base (6) is formed to be inwardly inclined in step-shaped manner, wherein the detent projections (23) are provided in a first, outer encircling step (8) and the ventilating opening (22) and sealing element (21) are provided in a more inwardly disposed second step (10).

11. The device of claim 10, wherein the sealing element comprises an annular seal (21).

* * * * *